United States Patent [19]

Rieg

[11] Patent Number: 4,723,334

[45] Date of Patent: Feb. 9, 1988

[54] DUAL DIRECTIONAL CARBON ANODE CLEANING APPARATUS

[75] Inventor: Joseph N. Rieg, Blaine, Wash.

[73] Assignee: Alumax Inc., San Mateo, Calif.

[21] Appl. No.: 834,793

[22] Filed: Feb. 28, 1986

[51] Int. Cl.[4] ..... B08B 1/00

[52] U.S. Cl. ..... 15/91; 15/93 R; 134/6

[58] Field of Search ..... 15/89, 91, 312, 93 R, 15/4; 164/158; 29/81 D; 134/6; 209/382

[56] References Cited

U.S. PATENT DOCUMENTS

| | | | |
|---|---|---|---|
| 1,741,959 | 12/1929 | Speck et al. . | |
| 3,224,022 | 12/1965 | Kehr . | |
| 4,418,435 | 12/1983 | Arnold | 15/89 |
| 4,557,009 | 12/1985 | Dill | 15/91 |

*Primary Examiner*—Edward L. Roberts

*Attorney, Agent, or Firm*—Limbach, Limbach & Sutton

[57] ABSTRACT

A dual directional spent carbon anode cleaning apparatus for removing cryolite from a spent carbon anode, the spent carbon anode has longitudinally extending sides and transversely extending ends. The apparatus comprises side cleaning means, the side cleaning means including side hammer means that extends across one of the longitudinal sides of the spent carbon anode for pounding and loosening the cryolite. The apparatus also comprises end cleaning means, the end cleaning means including end hammer means that extends across one of the transverse ends of the spent carbon anode for pounding and loosening the cryolite, the end hammer means is oriented at a direction that is approximately orthogonal to the direction of travel of the side hammer means.

12 Claims, 16 Drawing Figures

DUAL DIRECTIONAL CARBON ANODE CLEANING APPARATUS

DESCRIPTION

1. Technical Field

This invention relates to a carbon anode cleaning apparatus, and more particularly, to a dual directional carbon anode cleaning apparatus.

2. Background Art

Carbon anodes are used in the production of primary aluminum. Before a carbon anode is used in the production process, it is a block or ingot of carbon that is rectangular in configuration. This block of carbon is in turn mounted onto a steel bracket. The bracket generally includes two or more steel posts or pins which are mounted to a vertical support member. Conventional transporting apparatus is then used to transport the carbon anode by hoisting about the vertical supporting member. In the course of the production of aluminum, the carbon anode is consumed until only the portion immediately adjacent to the bracket is left. This portion is generally referred to as the spent carbon anode or carbon butt. Since cryolite is used in the aluminum production process, a coating of cryolite is adhered to the spent carbon anode.

Since spent carbon anodes are a reusable commodity in that they may be crushed and used in making new carbon blocks, they must first be cleaned before they are crushed and mixed with other carbon ingredients. To remove the cryolite from spent carbon anodes, machinery such as jackhammers are frequently used. The removal of cryolite maybe carried out not only manually but also by automatic apparatus such as the apparatus disclosed in Arnold, U.S. Pat. No. 4,418,435.

DISCLOSURE OF THE INVENTION

An ideal automatic carbon anode cleaning apparatus should be space conserving, that is, it should not occupy an inordinate amount of space in a manufacturing facility. For example, the apparatus disclosed in Arnold utilizes at least four processing and cleaning stations, which are arranged in a linear fashion. Such an arrangement requires space which is needed for other uses in the manufacturing facility. Thus, a paramount consideration in the design of an automatic carbon anode cleaning apparatus is the desire to conserve space.

An ideal carbon anode cleaning apparatus should also be capable of cleaning spent carbon anodes which are irregularly shaped. For example, the upper surface of the spent carbon anode in Arnold, the surface that is immediately adjacent to the steel posts, is substantially planar in configuration. Thus, the apparatus in Arnold, especially the jackhammer means, is not designed to clean irregularly-shaped spent carbon anodes.

It is a major object of the present invention to provide a dual directional carbon anode cleaning apparatus that occupies less space than prior art apparatus.

It is another object of the present invention to provide a dual directional carbon anode cleaning apparatus that employs only one station for cleaning the spent carbon anodes.

It is a further object of the present invention to provide a dual directional carbon anode cleaning apparatus that is capable of cleaning irregularly-shaped spent carbon anodes.

It is a still further object of the present invention to provide a dual directional carbon anode cleaning apparatus that is capable of cleaning spent carbon anodes which are mounted to multiple posts.

In order to accomplish the above and still further objects, the present invention provides a dual directional carbon anode cleaning apparatus for removing cryolite from a spent carbon anode; the spent carbon anode having longitudinally extending sides and transversely extending ends. The apparatus comprises side cleaning means, the side cleaning means including side hammer means that extends across one of the longitudinal sides of the spent carbon anode for pounding and loosening the cryolite. The apparatus also comprises end cleaning means, the end cleaning means including end hammer means that extends across one of the transverse ends of the spent carbon anode for pounding and loosening the cryolite. The end hammer means is oriented at a direction that is approximately orthogonal to the direction of travel of the side hammer means.

Other objects, features, and advantages of the present invention will appear from the following detailed description of the best mode of the preferred embodiment, taken together with the accompanying drawings.

BEST MODE FOR CARRYING OUT THE INVENTION

Figure 1:
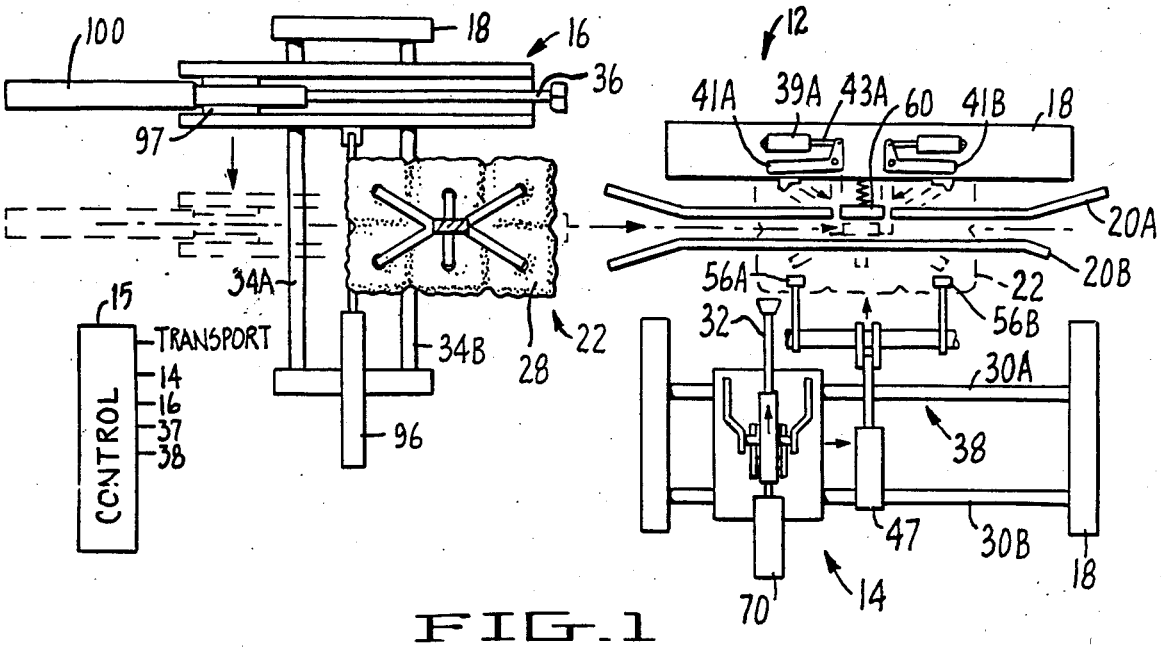
FIG. 1 is a plan, simplified, and diagrammatical view of a dual directional carbon anode cleaning apparatus of the present invention.

Referring to FIG. 1, there is shown a dual directional carbon anode cleaning apparatus, designated 12. Cleaning apparatus 12 comprises side cleaning means 14 and end cleaning means 16. In addition, cleaning apparatus 12 includes a frame 18 on which a pair of rails 20A and 20B are mounted.

Figure 2:
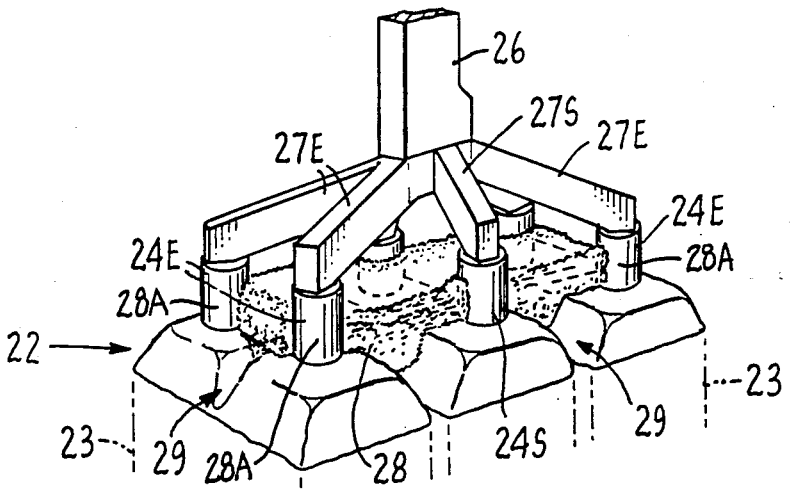
FIG. 2 is a partial perspective view of a spent carbon anode of FIG. 1, with a coating of cryolite thereon.

A carbon anode 23, before it was consumed in the aluminum manufacturing process, is a block or ingot that is rectangular in configuration, as illustrated in FIG. 2 as dotted lines. Each carbon anode 23 is mounted onto two steel posts or pins 24. Each steel post 24 in turn is mounted on a strut member 27. In the preferred embodiment, three carbon anodes 23 are mounted onto six steel posts—four end posts 24E and two side posts 24S. The strut members are similarly designated as either end strut members 27E or side strut members 27S. All six strut members 27E and 27S are mounted to a vertical support member 26. Posts 24E and 24S, strut members 27E and 27S, and vertical support member 26 constitute a bracket. In the preferred embodiment, a coating 28A of aluminum is sprayed onto not only carbon anodes 23, but also steel posts 24E and 24S and possibly strut members 27E and 27S and support member 26. This coating of aluminum, approximately ¼ inch in the preferred embodiment, is used as a sealant to prevent the oxidation of carbon anodes 23.

After carbon anodes 23 have been consumed in the manufacturing process, each carbon anode 23 resembles two frustums, separated by a crevice 29. For ease in description, the three spent carbon anodes 23 are hereinafter collectively referred to as a spent carbon anode or carbon butt 22. Moreover, the side of spent carbon anode 22 immediately adjacent to each set of end post 24E, side post 24S and end post 24E is defined as a longitudinal side. Similarly, the side of spent carbon anode 22 immediately adjacent to a pair of end posts 24E is defined as a transverse end.

Further, a coating of cryolite 28 is adhered to spent carbon anode 22. Cryolite 28 adheres not only to crevices 29 but also to posts 24E and 24S, as best shown in FIG. 2. The presence of crevices 29 creates an irregularly-shaped spent carbon anode 22; the shape of spent anode 22 immediately adjacent to each post 24 is domed in profile. Since spent carbon anodes 22 are a reusable commodity, cryolite 28 must be cleaned off before spent carbon anodes 22 can be crushed for reprocessing. In addition, some of the sprayed aluminum 28A which lie underneath cryolite 28 must also be removed from spent carbon anode 22 and posts 24E and 24S.

In general, a spent carbon anode 22 having cryolite 28 thereon is transported into cleaning apparatus 12, as best shown in FIG. 1. Support member 26 is hoisted by conventional transporting apparatus, not shown, for travelling between rails 20A and 20B and then positioning at a predetermined location. That predetermined location is best illustrated by the dotted line outline of spent carbon anode 22 in FIG. 1.

Figure 3:
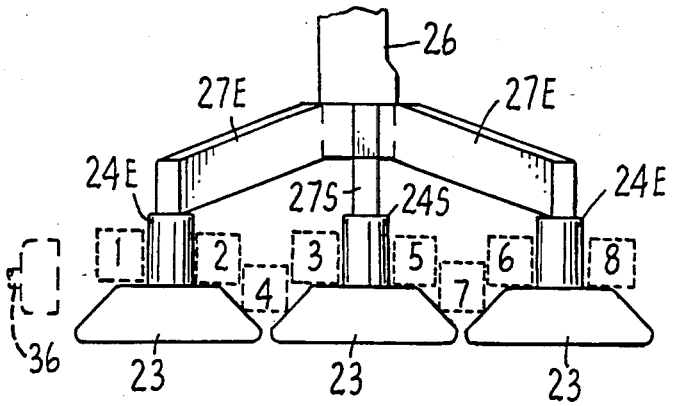
FIGS. 3 and 4 are diagrammatical views of the cleaning sequence of the apparatus of FIG. 1.
Figure 4:
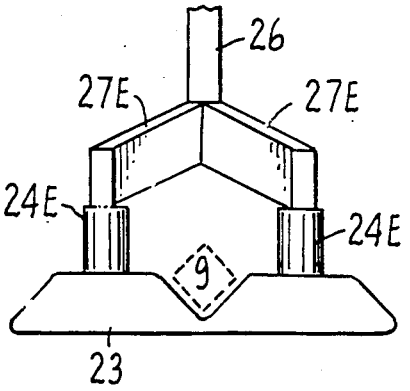

Side cleaning means 14, capable of travelling on rails 30A and 30B, includes a side hammer 32. Since it travels on rails 30A and 30B, side cleaning means 14 may be positioned so as to permit side hammer 32 to pound and loosen cryolite 28 that has adhered to posts 24E and 24S and crevices 29 of spent carbon anode 22. The sequence of pounding by side hammer 32 is illustrated in FIG. 3. Side hammer 32 first pounds cryolite 28 and sprayed aluminum 28A on either side of an end post 24E, as denoted by positions 1 and 2. In its pounding of cryolite 28, side hammer 32 extends from the near longitudinal side of spent anode 22 to the far longitudinal side of spent anode 22. Since the removal of cryolite 28 also removes sprayed aluminum 28A that is adhered to spent carbon anode 22, the removal of spray aluminum 28A is not hereinafter discussed separately unless appropriate. Side hammer 32 then pounds cryolite at position 3 which denotes one side of a side post 24S. The next position for side hammer 32 is the loosening of cryolite between a crevice 29 of two adjoining anodes 23. The side hammer 32 then continues on and completes the sequence as illustrated in FIG. 3. Once this sequence has been completed, end cleaning means 16, mounted on parallel rails 34A and 34B, proceeds to use its end hammer 36 to pound and loosen cryolite 28 between end posts 24E and crevice 29, as best illustrated in FIG. 4. End hammer 36 is capable of cleaning cryolite 28 from the entire length of spent carbon anode 22; cleaning from the nearmost pair of end posts 24E, pass through the pair of side posts 24S and to the distant pair of end posts 24E. Side hammer 32 and end hammer 36 in the preferred embodiment are pneumatic breakers. Hammerheads for side hammer 32 and end hammer 36 are designated as hammerheads 33.

Figure 5:
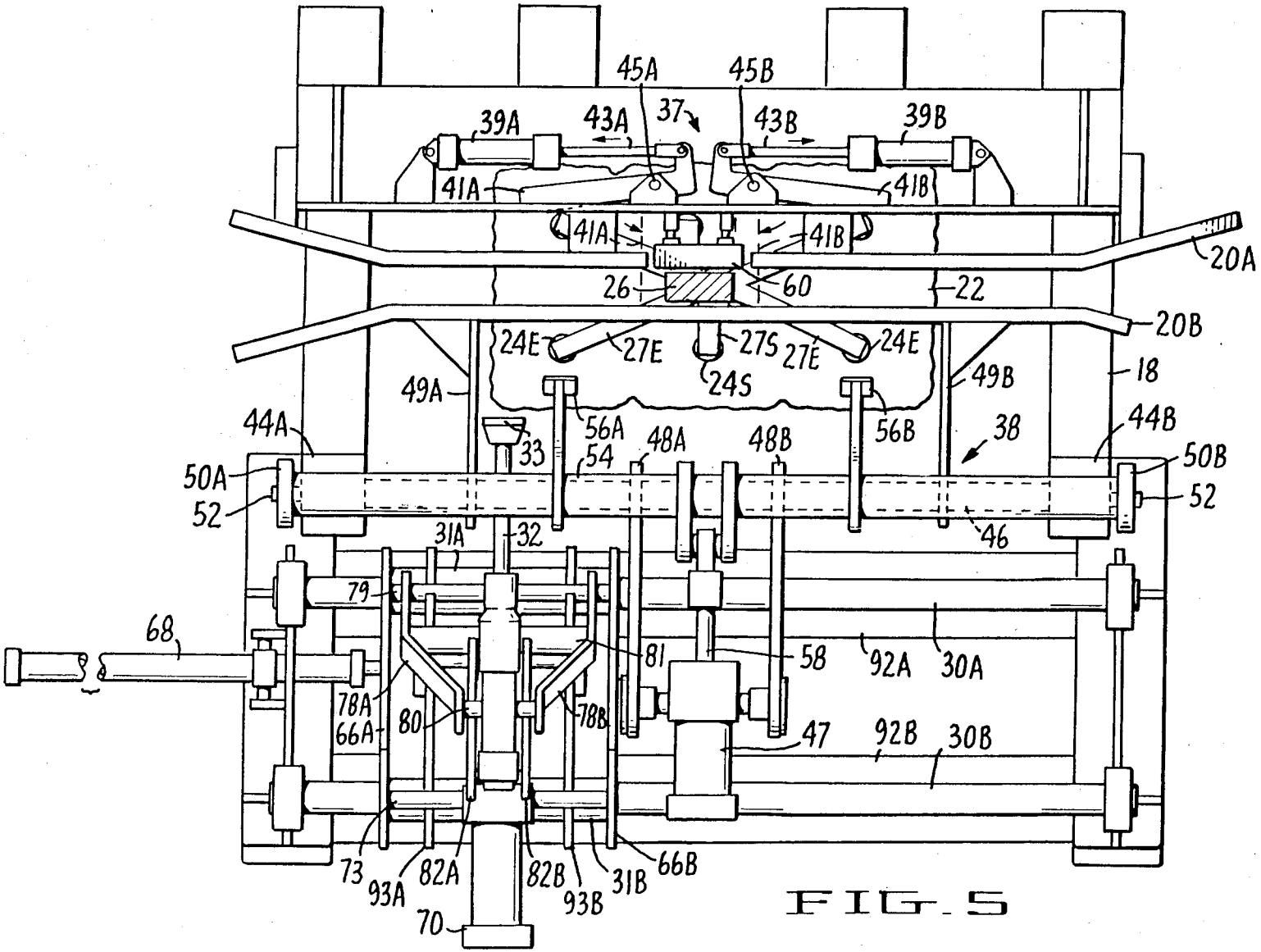
FIG. 5 is a plan, detailed view of the apparatus of FIG. 1.
Figure 7:
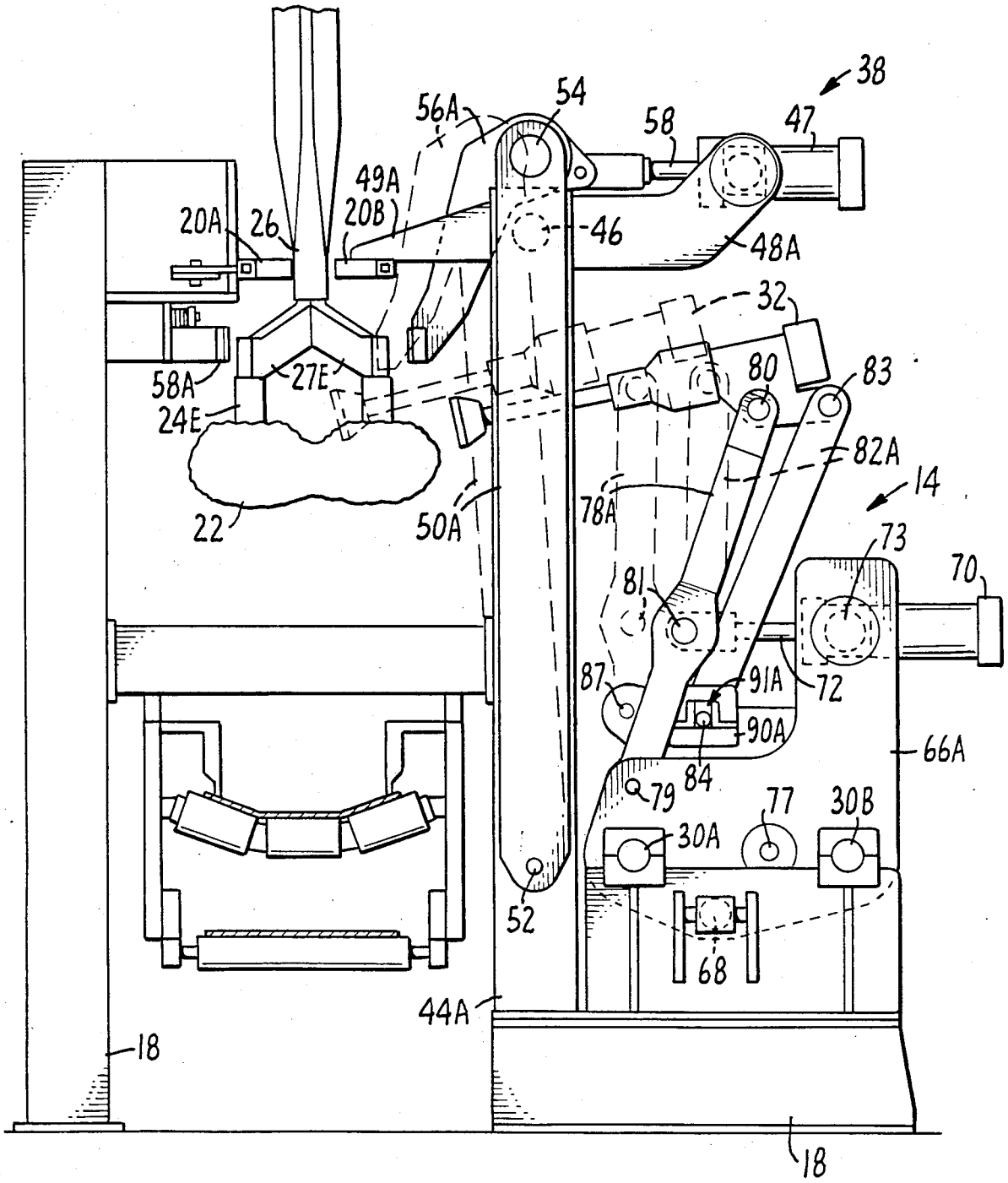
FIG. 7 is an end, detailed and diagrammatical view of the apparatus of FIG. 1.
Figure 8:
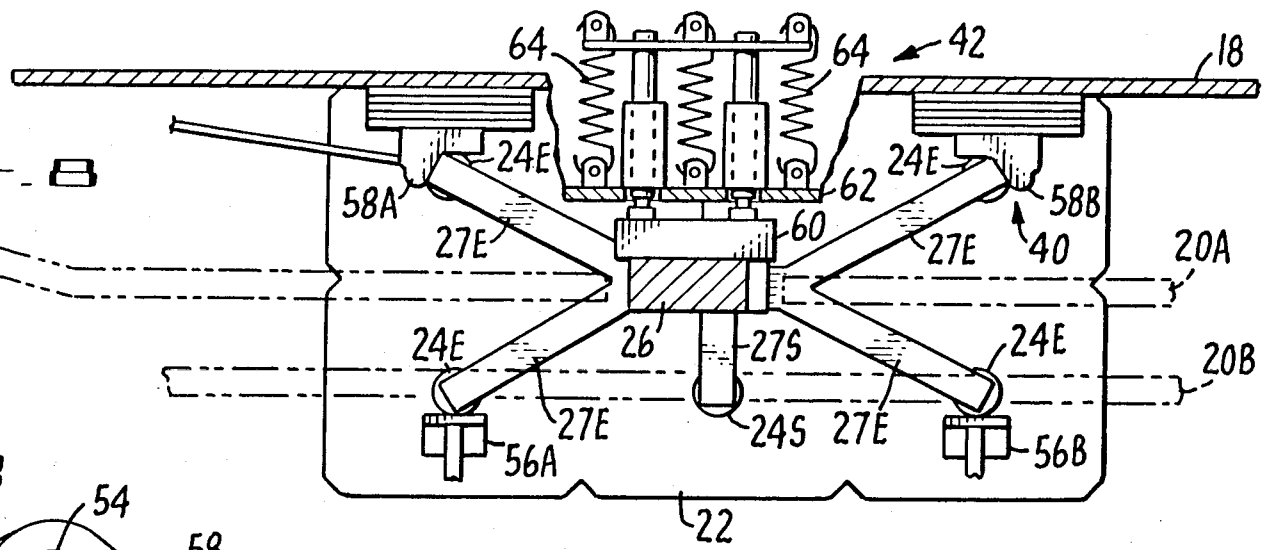
FIG. 8 is a plan, enlarged and cross section view of the carbon anode restraining means, carbon anode alignment means and rail spring means of the apparatus of FIGS. 1 and 5–7, with portions broken away.
Figure 9:
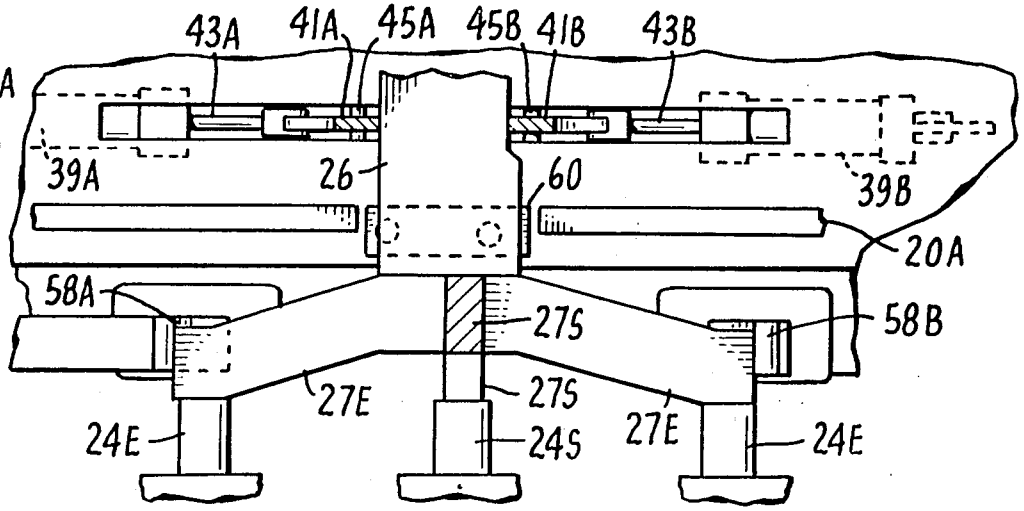
FIG. 9 is a side, enlarged and cross section view of the carbon anode centering means, carbon anode alignment means and spring rail means of the apparatus of FIGS. 1 and 5–7, with portions broken away.
Figure 10:
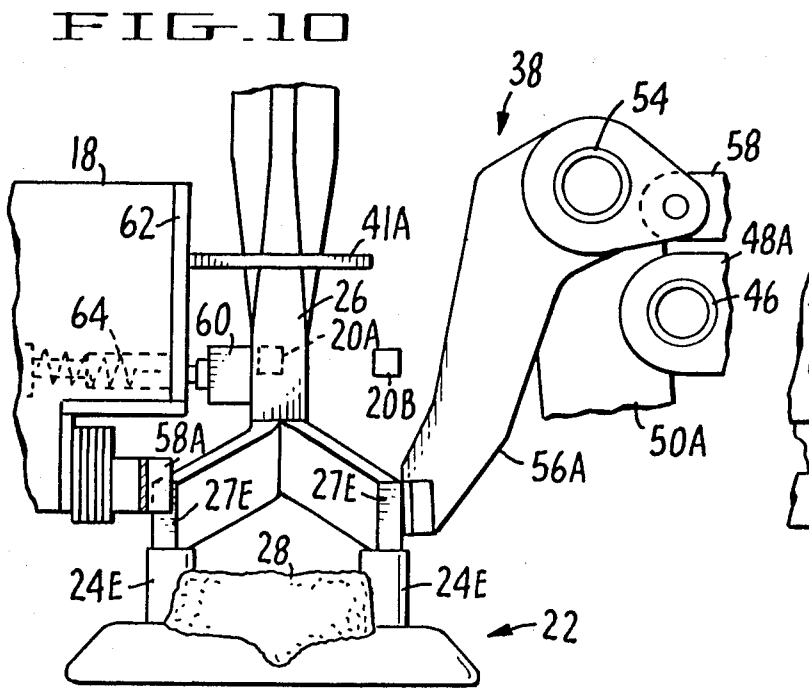
FIG. 10 is an end, enlarged view of the carbon anode restraining means, carbon anode centering means, carbon anode alignment means and spring rail means of the apparatus of FIGS. 1 and 5–7, with portions broken away.

Cleaning apparatus 12 also includes carbon anode centering means 37, carbon anode restraining means 38, carbon anode alignment means 40, and rail spring means 42, as best shown in FIGS. 5–10. When support member 26, travelling between rails 20A and 20B, has stopped at its approximate location, as best shown in FIGS. 1 and 5, carbon anode centering means 37 is activated to center spent carbon anode 22 for cleaning. Carbon anode centering means 37, as best shown in FIGS. 5, 9 and 10, includes a pair of pneumatic piston means 39A and 39B, and a pair of centering arms 41A and 41B. Piston means 39A and 39B include piston rods 43A and 43B, respectively. Centering arms 41A and 41B in turn are connected to piston rods 43A and 43B, respectively. In addition, centering arms 41A and 41B pivot about axle 45A and 45B, respectively.

In operation, when vertical support member 26 has reached the approximate location, pistons means 39A and 39B are activated so as to retract piston rods 43A and 43B. This action causes centering arms 41A and 41B to pivot about axles 45A and 45B, respectively. Centering arms 41A and 41B then move toward support member 26 in the manner illustrated by the arrows in FIG. 5. When centering arms 41A and 41B are fully extended, as best shown by the dotted lines in FIG. 5, the cross section view of FIG. 9 and the side view of FIG. 10, they have centered support member 26 for further operation. Although centering of spent anode 22 is being performed for the efficacious removal of cryolite 28, centering of spent carbon anode 22 is also necessary when there is an imbalance of the weight of spent anode 22. For example, if an anode 23 attached to one pair of end posts 24E had fallen off during the aluminum making process or during the transfer of spent anode 22, spent anode 22 is unbalanced and tilting at an undesired angle. Or, if an inordinate amount of cryolite 28 had adhered to one pair of end posts 24E, spent anode 22 will be similarly unbalanced. In either event, spent carbon anode 22 would be travelling in an imbalanced fashion, thereby requiring centering before side cleaning means 14 can properly clean spent anode 22. In addition, the centering action of centering arms 41A and 41B also dampens the pendular swing of support member 26 which is caused by the sudden stop of the overhead transporting apparatus.

Figure 6:
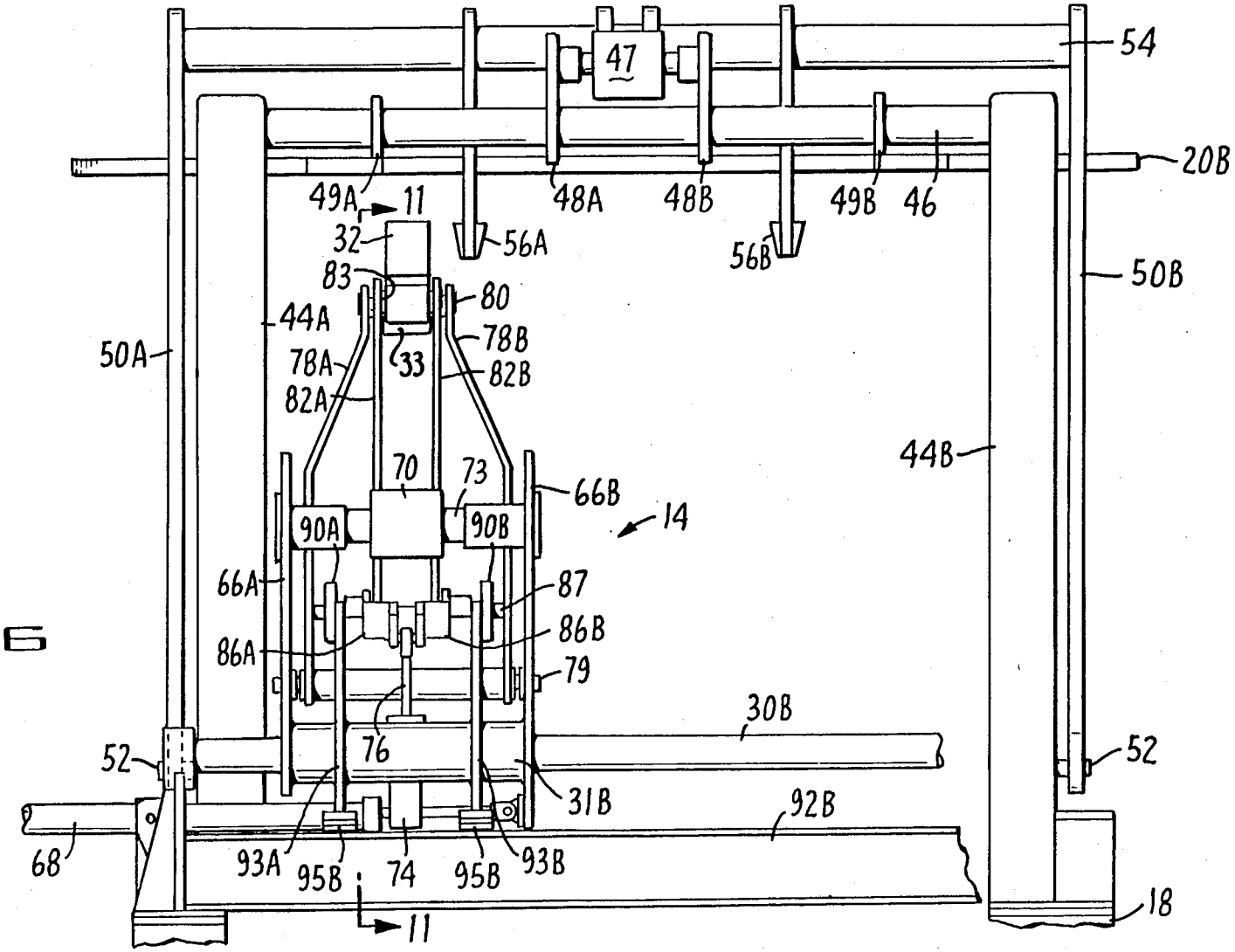
FIG. 6 is a side, detailed view of the apparatus of FIG. 1, with portions broken away.

Carbon anode restraining means 38 is then activated to secure spent carbon anode 22 for cleaning. Carbon anode restraining means 38, as best shown in FIGS. 5–7, includes stationary side posts 44A and 44B which are mounted onto frame 18. Mounted across stationary posts 44A and 44B is a stationary cross member 46. In turn, two parallel brackets 48A and 48B are mounted onto stationary cross member 46. Rotatably mounted between brackets 48A and 48B is piston means 47. A pair of extension brackets 49A and 49B are mounted between cross member 46 and rail 20B. Carbon anode restraining means 38 also includes a pair of pivotable posts 50A and 50B which are connected to stationary posts 44A and 44B by axle 52. Mounted across pivotable posts 50A and 50B is cross member 54. Mounted onto cross member 54 is a pair of restraining prongs 56A and 56B. In addition, cross member 54 is connected to a piston rod 58, which in turn is received within piston means 47.

In operation, the activation of piston means 47 extends piston rod 58, which in turn pushes cross member 54 towards spent carbon anode 22, as best shown in FIG. 7. As cross member 54 moves towards spent carbon anode 22, as best shown by the dotted line in FIG. 7, posts 50A and 50B, which are connected to cross member 54, pivot about axle 52. When piston rod 58 has pushed cross member 54 to a certain position, restraining prongs 56A and 56B contact end strut members 27E of spent carbon anode 22, as best shown in FIG. 7. Restraining prongs 56A and 56B, pushing on end strut members 27E, clamps the entire bracket to alignment means 40. Carbon anode restraining means 38 also alleviates the imbalanced carbon anode situation previously described by restraining spent anode 22 to a position that permits side cleaning means 14 to effectively clean spent anode 22.

Alignment means 40, as best shown in FIGS. 8–10, includes two alignment corners or sockets 58A and 58B. Corners 58A and 58B are adapted to engage and receive the other pair of end strut members 27E which are not in contact with restraining prongs 56A and 56B. Similarly, alignment means 40 alleviates the imbalanced spent anode situation as described previously.

Spring rail means 42, as best shown in FIG. 9, includes a translatable rail segment 60 that is attached to a plate 62, which in turn is connected to a plurality of springs 64. Rail segment 60 is normally a portion of rail 20A. When restraining means 38 pushes spent carbon anode 22 towards alignment means 40, vertical support member 26 occupies the space vacated by rail segment 60.

Side cleaning means 14, as best shown in FIGS. 5–7 and 11–12, includes frames 66A and 66B which are slideably mounted onto rails 30A and 30B. Connected between frames 66A and 66B are a pair of annular sleeves 31A and 31B which are slideably mounted onto rails 30A and 30B, respectively. Annular sleeves 31A and 31B are used so as to withstand the generally dusty environment of apparatus 12. A piston rod 68 is connected to both frame 66B and a piston means, not shown. The actuation of piston rod 68 moves frames 66A and 66B on rails 30A and 30B. Side cleaning means 14 is designed to travel on rails 30A and 30B a distance of approximately 48 inches. More particularly, side cleaning means 14 comprises first or horizontal piston means 70 which includes a horizontal piston rod 72. Horizontal piston means 70 is mounted onto frames 66A and 66B via axle 73. Side cleaning means 14 also comprises second or vertical piston means 74 which in turn includes a vertical piston rod 76. Vertical piston means 74 is mounted onto frames 66A and 66B via axle 77.

Side cleaning means 14 also includes a pair of first or forward brackets 78A and 78B. Forward brackets 78A and 78B are mounted onto frames 66A and 66B via axle 79. Side pneumatic breaker 32 is mounted onto forward brackets 78A and 78B via axle 80. Horizontal piston rod 72 is connected to forward brackets 78A and 78B via axle 81. A similar pair of second or rear brackets 82A and 82B are provided. Side pneumatic breaker 32 is mounted onto rear brackets 82A and 82B via axle 83. Each pair of forward bracket 78A and rear bracket 82A is referred to as a parallelogram linkage. The other pair of brackets 78B and 82B is a similar parallelogram linkage. The other ends of rear brackets 82A and 82B are mounted onto axle 84. Axle 84 in turn is mounted onto a pair of translational brackets 86A and 86B. Translational brackets 86A and 86B are mounted onto forward brackets 78A and 78B via axle 87 and mounted onto vertical piston rod 76 via axle 88. Further, a pair of brackets 90A and 90B are provided each of which includes a rectangular aperture, designated 91A and 91B, respectively.

In operation, the activation of side cleaning piston means, not shown, activates piston rod 68 which in turn translates frames 66A and 66B on rails 30A and 30B to the first of the positions illustrated in FIG. 3. At that position, horizontal piston means 70 and vertical piston means 74 are actuated to raise side pneumatic breaker 32 to the appropriate location. Horizontal piston means 70 activates piston rod 72 so as to affect the horizontal distance between side pneumatic breaker 32 and carbon anode 22. The horizontal motion of piston rod 72 moves forward brackets 78A and 78B, which in turn moves forward side pneumatic breaker 32.

For the vertical motion, the activation of piston rod 76 translates axle 88 in a vertical fashion. This motion in turn causes translational brackets 86A and 86B to pivot about axle 87. The movement of translational brackets 86A and 86B in turn elevates rear brackets 82A and 82B since they are connected by axle 84, causing side pneumatic breaker 32 to pivot about axle 83. In addition, the vertical motion also pivots side pneumatic breaker 32 about axle 80. Apertures 91A and 91B of brackets 90A and 90B are provided to permit the vertical movement of axle 84, which is received within apertures 91A and 91B. The movement of rear brackets 82A and 82B tilts side pneumatic breaker 32 to a variety of angles so as to permit the pounding of cryolite 28 from a variety of trajectories.

Figure 11:
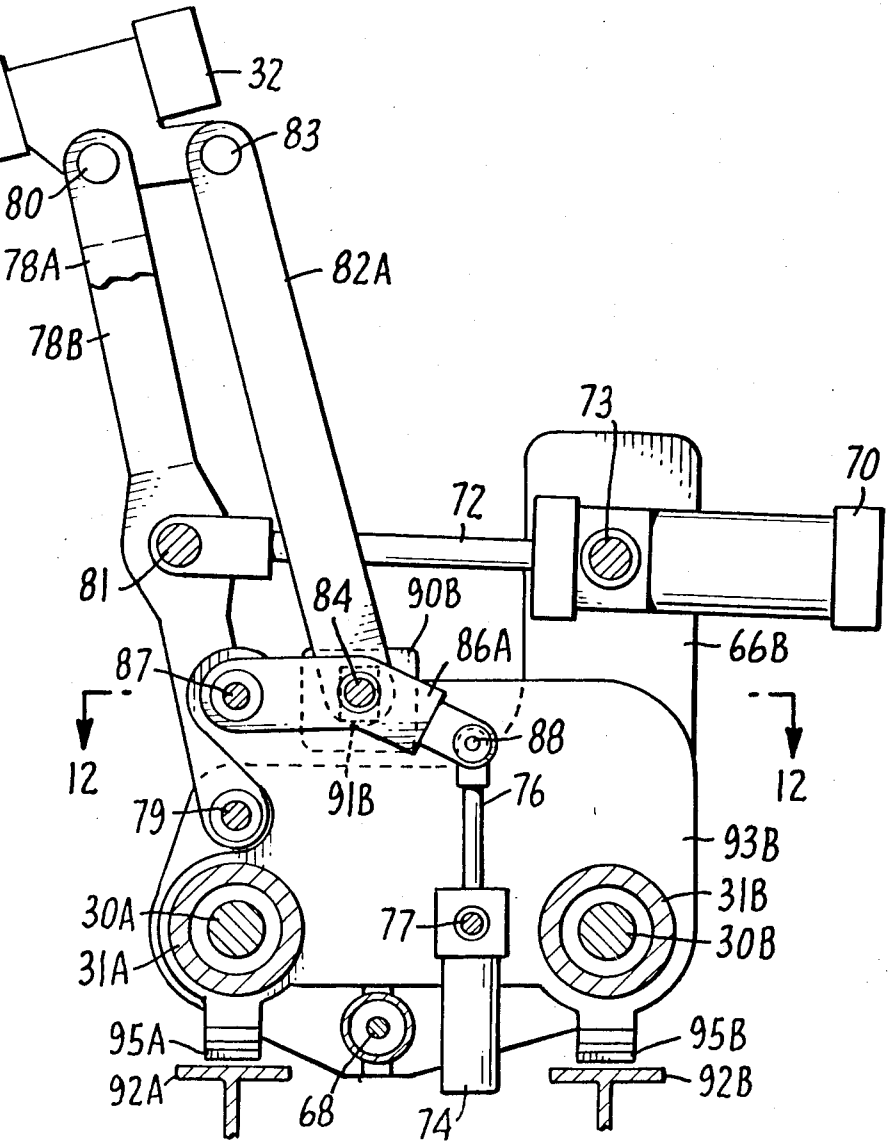
FIG. 11 is a side, enlarged and cross section view of the side cleaning means of the apparatus of FIGS. 1 and 5–7, with portions broken away.
Figure 12:
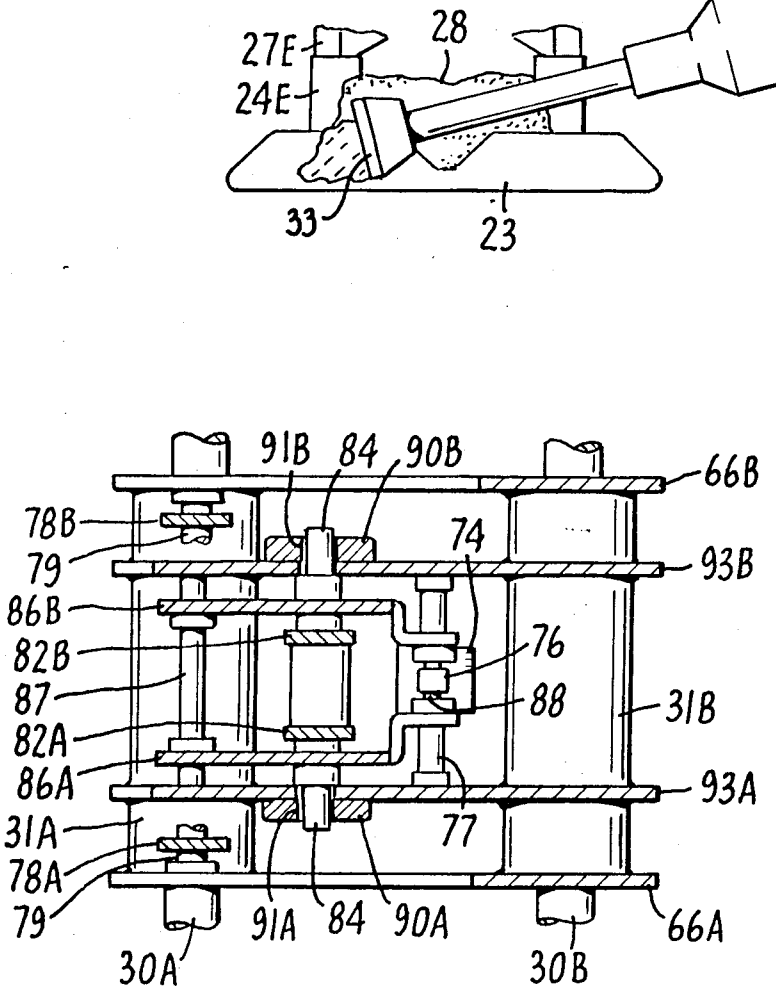
FIG. 12 is a plan, enlarged and cross section view of the internal aspects of the side cleaning means of FIG. 11, with portions broken away.

The tilting of side pneumatic breaker 32 to the desired angle or trajectory is best illustrated by the movement of axle 84, which is connected to both rear brackets 82A and 82B and translational brackets 86A and 86B. As best shown in FIG. 7, side pneumatic breaker 32 is at its first or retracted angle, as evidenced by the fact that axle 84 is at the lower portion of aperture 91A of bracket 90A. In FIG. 11, side pneumatic breaker 32 is at another angle, e.g., pounding cryolite 28, as evidenced by the fact that axle 84 is at a second and higher location within aperture 91B. Each of apertures 91A and 91B has a vertical dimension in the range of $\frac{3}{4}$ inch to $\frac{7}{8}$ inch. The vertical displacement ratio between pneumatic breaker 32 and axle 84 is approximately 4:1, i.e., for every $\frac{1}{4}$ inch of upward movement of axle 84 within apertures 91A and 91B, pneumatic breaker 32 would move upward approximately one inch. At a maximum, hammerhead 33 of side pneumatic breaker 32 is capable of elevating three inches in the vertical direction.

The capability of apparatus 12 to adjust the tilt angle of side pneumatic breaker 32 permits apparatus 12 to clean irregularly-shaped spent carbon anodes 22. This adjustment or tilting capability is the result of the cooperative actions of piston means 70 and 74, translational brackets 86A and 86B, and the parallelogram linkages, i.e., forward brackets 78A and 78B and rear brackets 82A and 82B. Since side pneumatic breaker 32 may be positioned at a variety of angles, it is capable of pounding cryolite 28 that has adhered not only to the nearmost posts 24 and crevices 29, as shown in FIG. 7, but also distant posts 24 and crevices 29, as shown in FIG. 11. In the preferred embodiment, hammerhead 33 of side pneumatic breaker 32 is capable of traveling 30 inches in the horizontal direction, which is more than the width of spent carbon anode 22.

In use, if side cleaning means 14 is performing its operation at position 1, 2, 3, 5, 6 or 8, i.e., pounding cryolite 28 and sprayed aluminum 28A that has adhered to a steel post 24, vertical piston means 74 is in its retracted position, as illustrated by the position of axle 84 in FIG. 7. If side cleaning means 14 is performing its operation at positions 4 and 7, vertical piston means 74 is activated, i.e., the position as illustrated by axle 84 in FIG. 11, to pound cryolite 28 at a desired trajectory. At each of the positions 1–8, horizontal piston means 70 is activated, projecting piston rod 72 towards spent carbon anode 22. This movement is generally referred to as a stroke, and each stroke is approximately three seconds in duration. Simultaneously, pneumatic breaker 32 is activated, causing hammerhead 33 to pound cryolite 28 at the rate of approximately 20 blows per second. Thus, each stroke of piston rod 72 generally accomplishes all of the necessary cleaning for each position.

Cleaning apparatus 12 further includes a pair of beams 92A and 92B. Each of beams 92A and 92B is positioned immediately below one of the rails 30A and 30B so as to absorb the force generated by side pneumatic breaker 32 on the entire side cleaning means 14. A pair of shock absorption brackets 93A and 93B is provided. Shock absorption brackets 93A and 93B each includes a forward absorption post 95A and a rear absorption post 95B.

Figure 13:
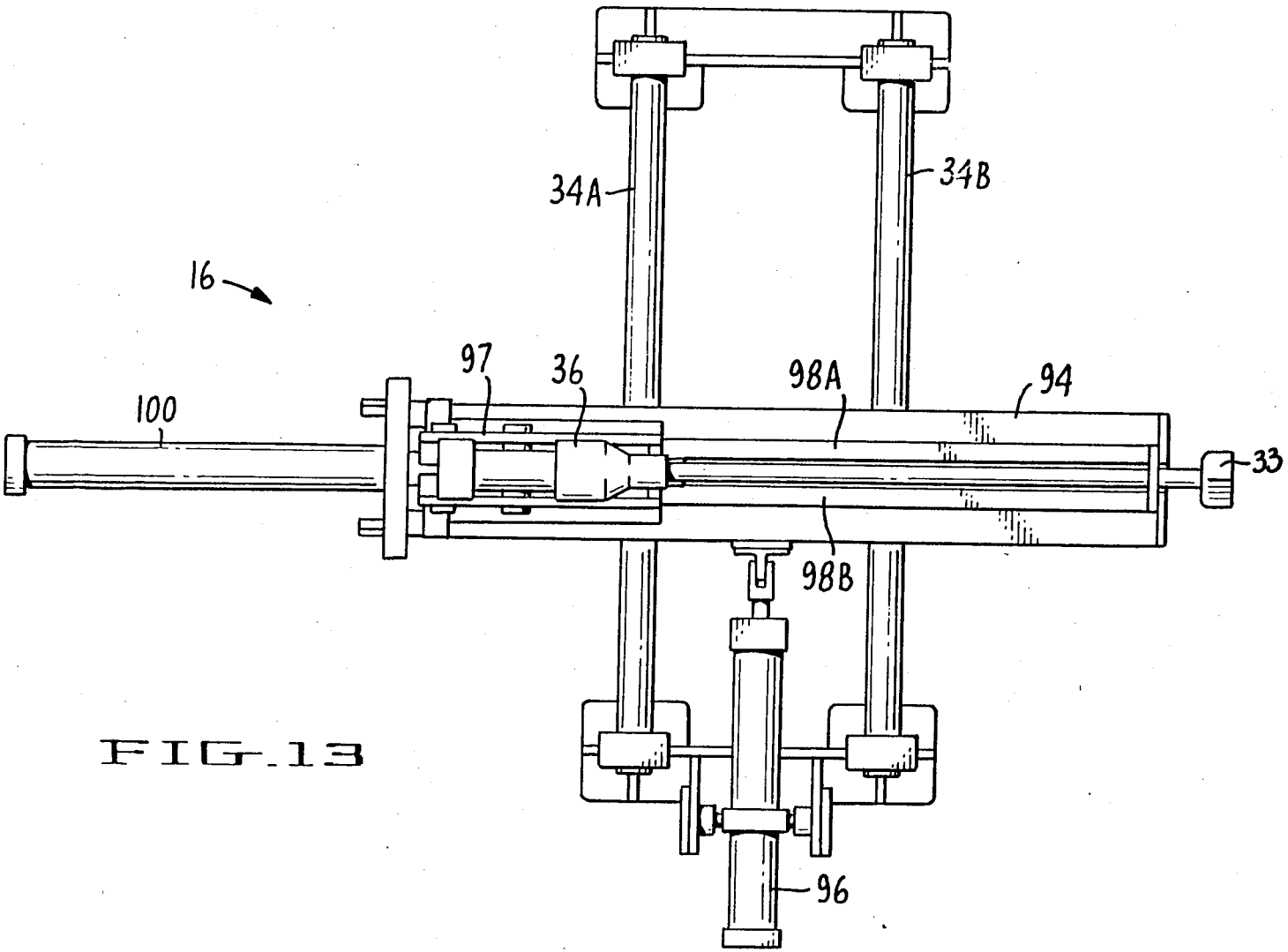
FIG. 13 is a plan, enlarged view of the end cleaning means of the apparatus of FIG. 1.
Figure 14:
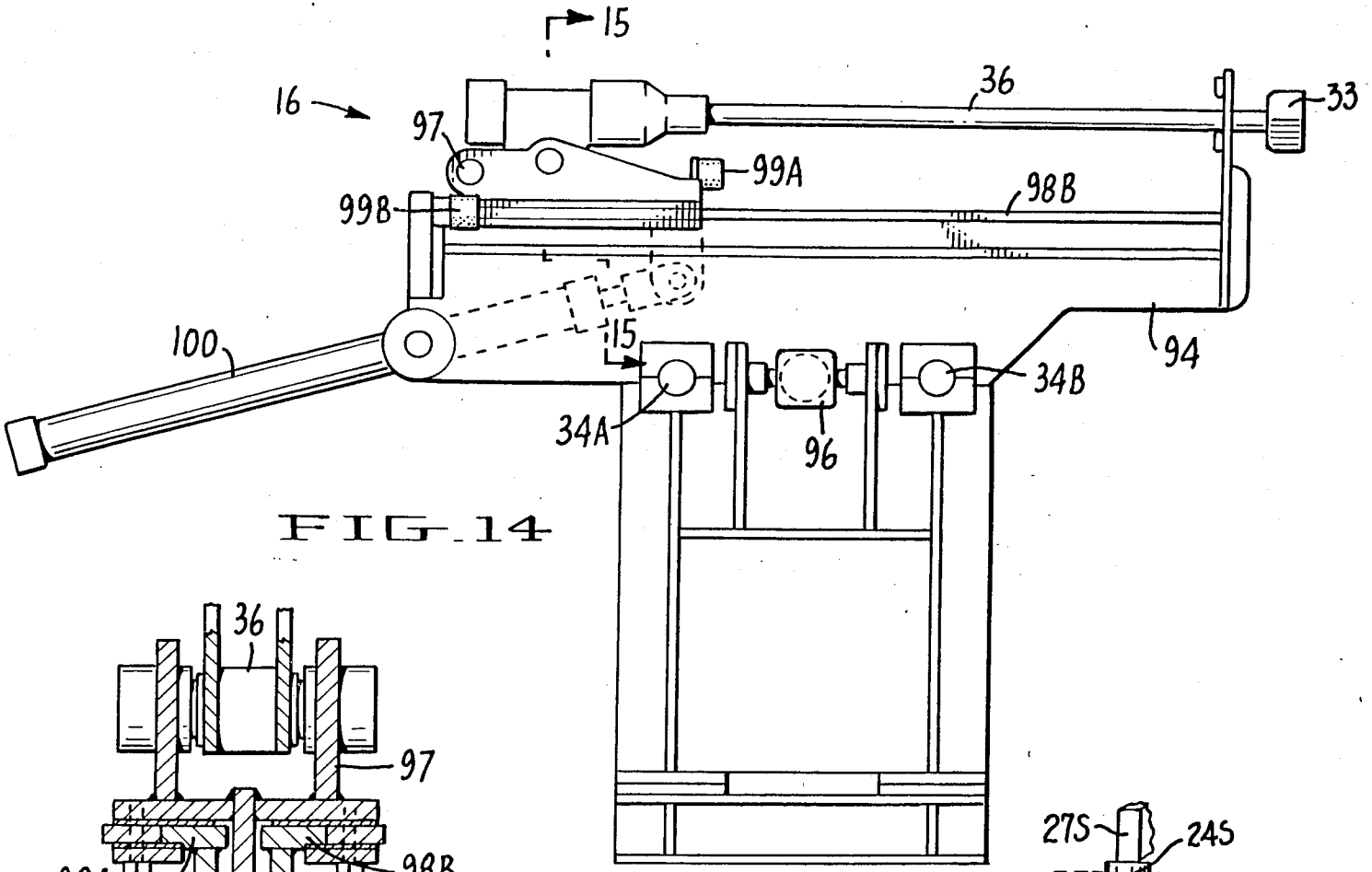
FIG. 14 is a side, enlarged view of the end cleaning means of FIG. 13.
Figure 15:
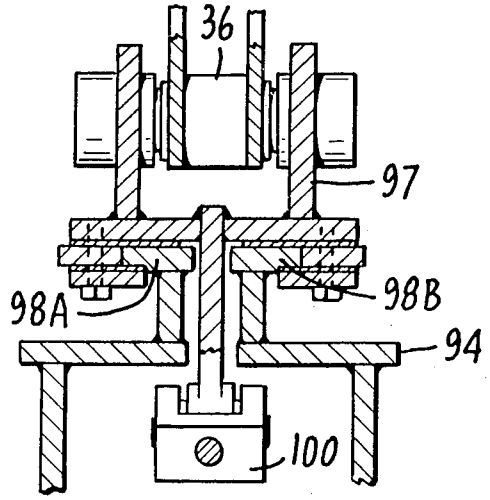
FIG. 15 is an end, enlarged and cross section view of the internal aspects of the end cleaning means of FIGS. 13 and 14, with portions broken away.

As best shown in FIGS. 13–15, end cleaning means 16 comprises a frame 94 that is slideably mounted onto rails 34A and 34B. In addition, end cleaning means 16 further comprises piston means 96 for moving end cleaning means 16 on rails 34A and 34B. Further, end cleaning means 16 includes a pair of hammer rails 98A and 98B onto which end pneumatic breaker 36 is mounted. End pneumatic breaker 36 is mounted onto a carriage 97 which in turn is slideably mounted onto rails 98A and 98B. Carriage 97 includes a forward stop 99A and a rear stop 99B. To move end pneumatic breaker 36 in the longitudinal direction, hammer piston means 100 is provided to perform this movement. Hammer piston means 100 is connected to carriage 97.

In operation, once side cleaning means 14 has completed its cleaning sequence, piston means 96 is activated to move end cleaning means 16 on rails 34A and 34B so as to center end pneumatic breaker 36 between two end posts 24E, e.g., position 9 of FIG. 4. Hammer piston means 100 is then activated to permit end pneumatic breaker 36 to pound and dislodge cryolite 28 from spent carbon anode 22. End pneumatic breaker 36 is capable of cleaning cryolite 28 from the nearmost pair of end posts 24E to the distant pair of end posts 24E.

Once end cleaning means 16 has terminated its operation, carbon anode centering means 37 and carbon anode restraining means 38 are activated; centering arms 41A and 41B are retracted to their positions illustrated in FIG. 5 and restraining prongs 56A and 56B disengage end strut members 27E, returning to their positions illustrated in FIG. 7. Springs 64 then push rail segment 60 towards inner rail 20A, which in turn causes vertical support member 26 to return to its position illustrated in FIG. 5. This spring action also pops out the other pair of end strut members 27E from corners 58A and 58B. Overhead transporting apparatus is activated to transport cleaned spent carbon anode 22 to other worksites.

Since apparatus 12 has only two orthogonally oriented side cleaning means 14 and end cleaning means 16, it occupies a space smaller than apparatus in the prior art. In addition, the entire cleaning operation is carried out at a single station. Moreover, the cleaned spent carbon anodes 22 are not only irregularly-shaped but also mounted to multiple posts.

In the preferred embodiment, apparatus 12 is capable of being operated in a fully automated mode. Apparatus 12 is controlled by electronic programmable control means, designated 15, as shown in FIG. 1. Control means 15 controls the operation of overhead transportation apparatus, not shown, side cleaning means 14, end cleaning means 16, carbon anode centering means 37, and carbon anode restraining means 38. In particular, control means 15 controls the tilting operation of side pneumatic breaker 32, the activation of horizontal piston means 70 for generating a single forward stroke of piston rod 72, and the activation of side hammerhead 33.

Moreover, control means 15 controls the sequential pounding of cryolite 28 by side cleaning means 14 and end cleaning means 16. Apparatus 12 may also be operated in the semi-automatic mode where the operation of side cleaning means 14 and end cleaning means 16 are controlled by an operator. If apparatus 12 is in either the semi-automatic mode or a totally manual mode, an operator is controlling the activation of side cleaning means 14 and end cleaning means 16, and especially the tilt of side pneumatic breaker 32, by operating a conventional joystick.

Further, apparatus 12 is capable of sensing whether or not each of the pneumatic breaker is performing its desired function of pounding cryolite 28. For example, conventional sensors are mounted to horizontal piston means 70 of side cleaning means 14 and hammer piston means 100 of end cleaning means 16 for detecting the condition where pneumatic breakers 32 and 36 are uselessly hitting posts 24E or 24S. Similarly, the sensors also detect the condition where pneumatic breakers 32 and 36 are latched onto or hung-up on cryolite 28 or posts 24E and 24S during retraction. These sensors, which are conventional position sensors, detect these conditions by sensing either the lack of forward movement of either piston means 70 or piston means 100 for the first condition or the lack of rearward movement for the second condition. When either of these conditions is detected, either side pneumatic breaker 32 or end pneumatic breaker 36 is adjusted to return to its normal operation. This adjustment generally entails a simple side movement of either side pneumatic breaker 32 or end pneumatic breaker 36 to avoid the obstruction. When apparatus 12 is being operated manually, the operator can control the various avoidance maneuvers by using the joystick.

Figure 16:
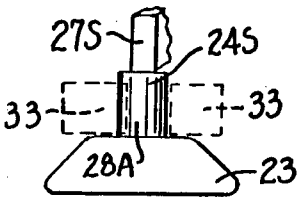
FIG. 16 illustrates the square configuration, in dotted lines, of the hammerhead of the side hammer means.

In addition, hammerhead 33 of pneumatic breaker 32 is square in configuration so as to maximize the impact area of the hammerhead. For example, when hammerhead 33 in FIG. 16 impacts tangentially on a post 24S, the square edge of hammerhead 33 produces a greater impact area on post 24S or any object than other hammerhead configurations. If hammerhead 33 has a circular configuration, only an arc of the circular configuration would impact tagentially on post 24S. The impact area of an arc is less than the impact area of a square edge. A square hammerhead 33, therefore, would readily dislodge coating 38A of sprayed aluminum from post 24S. Hammerhead 33 of end pneumatic breaker 36, however, is a square hammerhead that is oriented 45° from the orientation of side pneumatic breaker 32, as best illustrated in FIG. 4. It is therefore within the knowledge of one skilled in the art to orient hammerhead 33 of either side pneumatic breaker 32 or end pneumatic breaker 36 at any desired orientation.

It will be apparent to those skilled in the art that various modifications may be made within the spirit of the invention and the scope of the appended claims.

I claim:

1. A carbon anode cleaning apparatus for removing cryolite from a spent carbon anode of the type having longitudinally extending sides and traversely extending ends, the apparatus comprising a single cleaning station, wherein the single station comprises a:

carbon anode centering means for centering the spent carbon anode at a predetermined location;

carbon anode restraining means for retaining the spent carbon anode at the predetermined location in order to permit the side hammer means and end hammer means to pound and loosen the cryolite;

carbon anode alignment means for aligning the spent carbon anode at the predetermined location; and one of the rails includes spring rail means for accommodating the spent carbon anode when it is being aligned and restrained by the carbon anode alignment means and the carbon anode restraining means;

and overhead transportation means for transporting the spent carbon anode; wherein the overhead transportation means includes two parallel rails for guiding the spent carbon anode, wherein the improvement comprises:

side cleaning means, the side cleaning means including side hammer means that extends across one of the longitudinal sides of the carbon anode for pounding and loosening the cryolite; and end cleaning means, the end cleaning means including end hammer means that extends across one of the transverse ends of the spent carbon anode for pounding and loosening the cryolite, the end hammer means being oriented to move orthogonally with respect to the direction of travel of the side hammer means.

2. The apparatus as claimed in claim 1, wherein the spent carbon anode is an irregularly-shaped member.

3. The apparatus as claimed in claim 2, wherein the side cleaning means includes means for adjusting the angle of the side hammer means so as to permit the side hammer means to pound and loosen cryolite from the irregular-shaped spent carbon anode.

4. The apparatus as claimed in claim 1, 2 or 3, wherein the spent carbon anode includes multiple posts.

5. A dual directional carbon anode cleaning apparatus for removing cryolite from a spent carbon anode, the spent carbon anode is an irregularly-shaped member that has longitudinally extending sides, transversely extending ends and multiple posts, the apparatus comprising a single cleaning station, and overhead transportation means for transporting the spent carbon anode, the transportation means includes two parallel rails for guiding the spent carbon anode;

the single cleaning station comprises side cleaning means, the side cleaning means including side hammer means that extends across one of the longitudinal sides of the spent carbon anode for pounding and loosening the cryolite; and side hammer adjustment means for adjusting the angle of the side hammer means so as to permit the side hammer means to pound and loosen the cryolite from the irregularly-shaped spent carbon anode;

end cleaning means, the end cleaning means including end hammer means that extends across one of the transverse ends of the spent carbon anode for pounding and loosening the cryolite, the end hammer means is oriented at a direction that is approximately orthogonal to the direction of travel of the side hammer means;

carbon anode centering means for centering the spent carbon anode at a predetermined location;

carbon anode restraining means for retaining the spent carbon anode at the predetermined location in order to permit the side hammer means and end hammer means to pound and loosen the cryolite; and carbon anode alignment means for aligning the spent carbon anode at the predetermined location; and one of the parallel rails includes spring rail means for accommodating the spent carbon anode when it is being aligned and restrained by the carbon anode alignment means and the carbon anode restraining means.

6. The apparatus as claimed in claim 5, wherein the side hammer adjustment means includes at least one adjustment plate having an aperature therein for permitting the adjustment of the angle of the side hammer means.

7. The apparatus as claimed in claim 5 or 6, wherein the carbon anode centering means includes a pair of centering arms for centering the spent carbon anode and dampening the pendular swing of the spent carbon anode.

8. The apparatus as claimed in claim 5 or 6, wherein the carbon anode restraining means includes at least one restraining prong for constraining the spent carbon anode to the carbon anode alignment means.

9. The apparatus as claimed in claim 5 or 6, wherein the carbon anode alignment means comprises two alignment corners for receiving and aligning the spent carbon anode.

10. The apparatus as claimed in claim 5 or 6, wherein the spent carbon anode includes six posts.

11. A dual directional carbon anode cleaning apparatus for removing cryolite from a spent carbon anode, the spent carbon anode is an irregularly-shaped member that has longitudinally extending sides, transversely extending ends and multiple posts, the apparatus comprising a single cleaning station, and overhead transportation means for transporting the spent carbon anode, the transportation means includes two parallel rails for guiding the spent carbon anode;

the single cleaning station comprises side cleaning means, the side cleaning means including side hammer means that extends across one of the longitudinal sides of the spent carbon anode for pounding and loosening the cryolite; and side hammer adjustment means for adjusting the angle of the side hammer means so as to permit the side hammer means to pound and loosen the cryolite from the irregularly-shaped spent carbon anode, the side hammer adjustment means includes at least one adjustment plate having an aperature therein for permitting the adjustment of the angle of the side hammer means;

end cleaning means, the end cleaning means including end hammer means that extends across one of the transverse ends of the spent carbon anode for pounding and loosening the cryolite, the end hammer means is oriented at a direction that is approximately orthogonal to the direction of travel of the side hammer means;

carbon anode centering means for centering the spent carbon anode at a predetermined location, the carbon anode centering means includes a pair of centering arms for centering the spent carbon anode and dampening the pendular swing of the spent carbon anode;

carbon anode restraining means for retaining the spent carbon anode at the predetermined location in order to permit the side hammer means and end hammer means to pound and loosen the cryolite, the carbon anode restraining means includes at least one restraining prong for constraining the spent carbon anode to the carbon anode alignment means; and carbon anode alignment means for aligning the spent carbon anode at the predetermined location, the carbon anode alignment means comprises two alignment corners for receiving and aligning the spent carbon anode;

one of the parallel rails includes spring rail means for accommodating the spent carbon anode when it is being aligned and restrained by the carbon anode alignment means and the carbon anode restraining means.

12. The apparatus as claimed in claim 11, wherein the spent carbon anode includes six posts.

* * * * *